US009489920B2

(12) United States Patent
Tusch

(10) Patent No.: US 9,489,920 B2
(45) Date of Patent: Nov. 8, 2016

(54) METHOD TO CONTROL DISPLAY DEVICE SCREEN BRIGHTNESS AND STRENGTH OF DYNAMIC RANGE COMPRESSION BASED ON AMBIENT LIGHT LEVEL

(71) Applicant: Apical Ltd, London (GB)

(72) Inventor: Michael Tusch, London (GB)

(73) Assignee: Apical Ltd., Loughborough (GB)

( * ) Notice: Subject to any disclaimer, the term of this patent is extended or adjusted under 35 U.S.C. 154(b) by 0 days.

(21) Appl. No.: 14/187,180

(22) Filed: Feb. 21, 2014

(65) Prior Publication Data

US 2014/0168288 A1 Jun. 19, 2014

Related U.S. Application Data

(63) Continuation of application No. PCT/EP2012/066370, filed on Aug. 22, 2012.

(30) Foreign Application Priority Data

Aug. 22, 2011 (GB) ..... 1114439.1

(51) Int. Cl.
*G09G 5/10* (2006.01)
*G09G 5/00* (2006.01)

(52) U.S. Cl.
CPC *G09G 5/10* (2013.01); *G09G 5/00* (2013.01); *G09G 2320/0247* (2013.01); *G09G 2320/0271* (2013.01); *G09G 2320/066* (2013.01); *G09G 2320/0626* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 4,090,216 | A | 5/1978 | Constable | |
| 5,760,760 | A | 6/1998 | Helms | |
| 6,812,649 | B2 | 11/2004 | Kim | |
| 7,302,110 | B2 | 11/2007 | Chesnokov | |
| 2002/0024529 | A1 | 2/2002 | Miller et al. | |
| 2005/0057484 | A1 | 3/2005 | Diefenbaugh et al. | |
| 2005/0068332 | A1 | 3/2005 | Diefenbaugh et al. | |
| 2005/0212824 | A1* | 9/2005 | Marcinkiewicz et al. | 345/690 |
| 2006/0132424 | A1* | 6/2006 | Foo et al. | 345/102 |
| 2008/0165116 | A1* | 7/2008 | Herz et al. | 345/102 |

(Continued)

FOREIGN PATENT DOCUMENTS

| | | | |
|---|---|---|---|
| CN | 1828711 | A | 9/2006 |
| CN | 1997165 | A | 7/2007 |

(Continued)

OTHER PUBLICATIONS

Mantiuk et al. "Display Adaptive Tone Mapping", ACM Transactions on Graphics, SIGGRAPH 2008, vol. 27 Issue 3, Aug. 2008.

(Continued)

*Primary Examiner* — Amr Awad
*Assistant Examiner* — Donna Lui
(74) *Attorney, Agent, or Firm* — EIP US LLP

(57) ABSTRACT

A method of controlling in a display device screen brightness and strength of dynamic range compression of display data in dependence on ambient light level. Ambient light level values are required from one or more ambient light sensors. The ambient light level values are averaged using a first method to obtain a first average value and using a second, different method to obtain a second average value. The first average value is used for controlling the screen brightness and the second average value is used for controlling the strength of the dynamic range compression.

12 Claims, 1 Drawing Sheet

(56) References Cited

U.S. PATENT DOCUMENTS

| | | | | |
|---|---|---|---|---|
| 2008/0284716 | A1* | 11/2008 | Edwards et al. | 345/102 |
| 2009/0167791 | A1 | 7/2009 | Shiomi | |
| 2009/0278828 | A1* | 11/2009 | Fletcher et al. | 345/207 |
| 2010/0053061 | A1 | 3/2010 | Leung et al. | |
| 2012/0169796 | A1 | 7/2012 | Kobiki et al. | |
| 2012/0182278 | A1* | 7/2012 | Ballestad | 345/207 |

FOREIGN PATENT DOCUMENTS

| | | | |
|---|---|---|---|
| CN | 101313351 | A | 11/2008 |
| CN | 101908330 | A | 12/2010 |
| EP | 1696414 | A1 | 8/2006 |
| EP | 195419 | A2 | 8/2008 |
| JP | 2006119200 | A | 5/2006 |
| JP | 2006285064 | A | 10/2006 |
| WO | 2011033669 | A1 | 3/2011 |

OTHER PUBLICATIONS

International Search Report and Written Opinion—PCT/EP2012/066370, dated Nov. 23, 2012.

* cited by examiner

METHOD TO CONTROL DISPLAY DEVICE SCREEN BRIGHTNESS AND STRENGTH OF DYNAMIC RANGE COMPRESSION BASED ON AMBIENT LIGHT LEVEL

CROSS-REFERENCE TO RELATED APPLICATIONS

The application is a continuation under 35 U.S.C. §120 of International Application No. PCT/EP2012/066370, filed Aug. 22, 2012 (and published on Feb. 28, 2013 in English by the International Bureau as International Publication No. WO2013/026891), which claims priority to GB Application No. 1114439.1, filed Aug. 22, 2011. The entire contents of each of the above-referenced patent application is hereby incorporated by reference.

BACKGROUND OF THE INVENTION

1. Field of the Invention

This application relates to a method for controlling a display device and to a display control system for carrying out the method.

2. Description of the Related Technology

It is known to incorporate an ambient light sensor in a display device so that the ambient light sensor data can be used to modify the screen brightness or the gamma curve or a combination of these two controls. For example, in a known display device incorporating an ambient light sensor, the screen brightness is controlled by adjusting the backlight intensity of the display device based on the ambient light level. The gamma curve of the display device is modified to compensate the image color brightness to the change in backlight. Modification of the gamma curve is a form of dynamic range compression.

It is desirable to improve the control of the screen brightness and the dynamic range compression in dependence on the ambient light level.

SUMMARY

Embodiments described herein relate to a method for controlling a display device and to a display control system for carrying out the method.

Before describing detailed embodiments referencing the Figures, embodiments will be described in summary form. In accordance with embodiments according to one aspect, there is provided a method of controlling in a display device screen brightness and strength of dynamic range compression of display data in dependence on ambient light level. The method may include acquiring ambient light level values from one or more ambient light sensors and averaging the ambient light level values using a first method to obtain a first average value. The method may further include averaging the ambient light level values using a second, different method to obtain a second average value and using the first average value for controlling the screen brightness. The second average value may then be used for controlling the strength of the dynamic range compression.

DETAILED DESCRIPTION OF CERTAIN INVENTIVE EMBODIMENTS

Certain disclosed embodiments are based on the recognition that using the same way of averaging the ambient light level to control both the screen brightness and the strength of the dynamic range compression is not optimal because of the different effect that changes in screen brightness and dynamic range compression strength have on an observer of the image displayed on the display device. Embodiments will now be described in detail.

Figure 1:
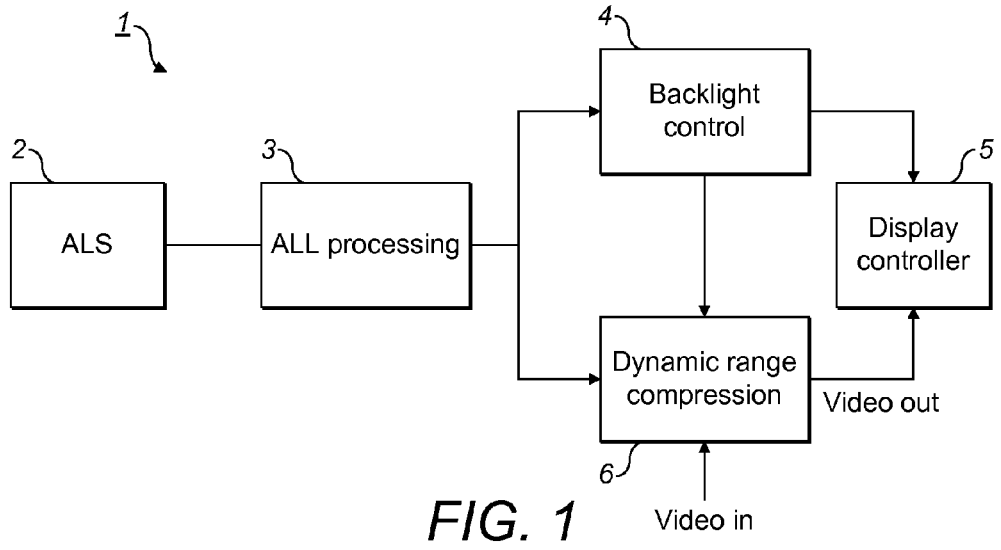
FIG. 1 shows a known display control system.

FIG. 1 shows a known display control system 1. An ambient light sensor 2 measures the ambient light incident on a display device and provides as output an ambient light level. An ambient light level processor 3 processes the ambient light level by a statistical method such as moving window averaging. The average value output by the ambient light level processor is input in a backlight control unit 4, which generates a signal for setting the intensity of the backlight in dependence on the average value. The signal is input to a display controller 5. The ambient light level may be used to decrease the display brightness in dark conditions and increase its brightness in bright conditions.

The same average value output by the ambient light level processor 3 is also used as input for a video processor 6, which can alter the brightness of individual pixels of the display device in order to increase or decrease their relative brightness values independent of the overall display brightness. This type of processing is known as dynamic range compression or tone mapping; see e.g. the article 'Display Adaptive Tone Mapping' by R. Mantiuk et al in ACM Transactions on Graphics, Vol. 27, No. 3, Article 68 of August 2008. The average value is used in the video processor 6 to control the strength of the dynamic range compression in order to achieve a better viewing experience in changing ambient light.

A video input of the video processor 6 is processed in dependence on the average signal and a signal from the backlight control unit 4 representing the backlight intensity. The video output of the video processor is input to the display controller 5.

The dynamic range compression adapts the content to be displayed to the contrast ratio of the display device. The contrast ratio of a display device is defined as the difference in brightness of the darkest and brightest pixels that the display device can simultaneously produce. Content to be displayed has a dynamic range determined by the difference in brightness of the darkest and brightest details within a given image or video frame. To show the content optimally, the contrast ratio of the display device should be larger than the maximal dynamic range of the content to be displayed.

The contrast ratio of a display device is reduced in the presence of ambient light compared to that in complete darkness, primarily due to reflections from the screen surface of the display device. As the ambient light level is increased, the dynamic range of the content and the contrast of the display device can be matched in two ways. Firstly, the contrast ratio of the display device can be increased by increasing the display brightness, for example by increasing the power delivered to an LED backlight in an LCD display device or by increasing the maximum power associated with a white pixel on an OLED display device. Secondly, the dynamic range of the content can be reduced by a dynamic range compression module using one of a variety of algorithms to match the reduced contrast.

The use of the same average signal for controlling both the display brightness and the strength of the dynamic range compression is not optimal because of the different effect of changes in display brightness and dynamic range compression.

The human eye is very sensitive to changes in display brightness, such that rapid changes commonly lead to an observable flicker which is irritating to the viewer. Also, some display devices, for example those based on OLED technology, are unable to change brightness continuously and can only select discrete brightness levels. The transition between one level and the next based on ambient light must be dampened to avoid rapid switching between two discrete values. For this reason, the common techniques of moving-window time filtering and hysteresis are widely employed.

However, changes in the strength of dynamic range compression may be effected rapidly without irritation to the viewer, especially if the dynamic range compression algorithm is locally adaptive, meaning that different processing strengths can be applied to different regions of an image or video frame, depending on its visual content. Examples of such locally adaptive algorithms are well known; see e.g. U.S. Pat. No. 7,302,110. Since the effect of ambient light on display contrast is primarily to raise the minimum grey level, being the darkest pixel intensity which is visible to the user, such a locally adaptive algorithm can selectively adjust only those pixels which are most affected by ambient light. This implies that dynamic range compression strength can be based on the actual light level, as opposed to a longer-term average, without risk of degrading image quality if the actual light level estimation is in error or is rapidly changing.

Figure 2:
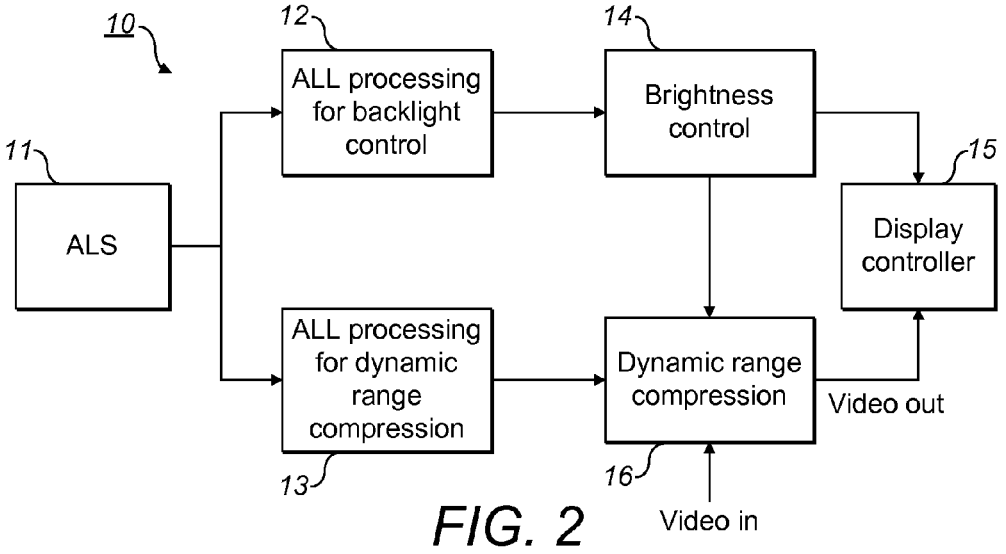
FIG. 2 shows a display control system according to embodiments.

Different processing of the ambient light levels for the brightness control and the dynamic range compression control may be used and different estimators of ambient light may be provided. This is realized in a display control system according to embodiments. FIG. 2 shows an embodiment of a display control system 10 according to embodiments. An ambient light sensor 11 measures the ambient light level. The ambient light level values are processed by a first ambient light level processor 12 and a second ambient light level processor 13, the two processors using a first and a second, different method, respectively, of processing the ambient light levels.

The first processor 12 uses a first method to form a first average value of the ambient light level values, which is input to a brightness control unit 14. An output signal of the brightness control unit 14 is input in a display controller 15, where it may be used for controlling the display brightness, for example by setting the intensity of a backlight of the display device or by setting the maximum brightness of a pixel such as in an OLED display device.

The second processor 13 uses a second method to form a second average value of the ambient light level values, which is input to a video processor 16, where it is used to set the strength of the dynamic range compression. The video output of the video processor is input to the display controller 15. Although the embodiment shown uses video input, embodiments can also be used for input of static images.

Although FIG. 2 shows the ambient light level processors 12 and 13 as separate processors, they may be integrated into a single processor. The same applies to the processors used in any of the elements 12-16, two or more of which may be integrated in one processor. The processing may be carried out in hardware in a circuit or as a computer program in a digital processor.

The ambient light levels obtained from the ambient light sensor 11 can be time averaged, e.g. to avoid rapid changes due to incorrect measurements caused by for example a user covering the sensor by his hand. A common method for temporal averaging is the moving window method, which forms a time-dependent first average value AL1j over the N most recent readings Li of the ambient light level:

$$AL1_j = N^{-1}\sum_{i=1}^{N} L_{j-i+1}$$

where consecutive readings are taken at intervals of Δt. The value of Δt may be determined by the rate at which the ambient light sensor delivers data, which may range from approximately 0.015 seconds to approximately 1 second. For example Δt may equal 0.1 seconds. Other methods for averaging are also possible.

The method may be refined by establishing a reset threshold, such that if an individual reading $L_i$ deviates significantly from the current average, $|L_{i+1}-L_i|>L_{th}$, $L_{th}$ being a predetermined threshold value, then the averaging window is reset. The method stabilizes the variation in the control of the display device while allowing for a discrete rapid change, for example if the user turns on or off room lights.

The averaging period, N Δt, for the brightness control may for example be 30 seconds or more. This period is unnecessarily long for the purpose of controlling dynamic range compression, which is less prone to producing observable flickering to the viewer. Hence, the averaging period for controlling the dynamic range compression is shorter than for the brightness control. The former averaging period may be less than 1 second.

The method for averaging the ambient light levels may alternatively use a recursive method for forming the second average value $AL2_j$, for example:

$$AL2_j = rL_j + (1-r)AL2_{j-1}$$

where r is a recursion coefficient, which may be set to 1 if most rapid adaptation is desired, for example in a moving vehicle, or reduced for example to 0.25 if a smoother variation is desired. The interval Δt can be in the range described above, for example 0.1 seconds. The interval may be equal to the interval used for determining the first average value, allowing both methods to use the same readings of the ambient light level.

In various embodiments, a moving window averaging method may be used for the ambient light sensor data for both screen brightness control and for dynamic range control. The screen brightness control averaging method may have N set to a relatively large value, for example 300, corresponding to an averaging time of 30 seconds, and the dynamic range control averaging method may have N set to a relatively small value, e.g. a value which may be less than one fifth or less than one tenth of that, for example, 10, corresponding to an averaging time of 1 second. An alternative is to use a recursive averaging method for both screen brightness control and for dynamic range control. The screen brightness control averaging method may have r set to a relatively low value, for example 0.05, and the dynamic range control averaging method may have r set to a relatively high value, e.g. a value which may be more than five times or more than ten times that value, for example 0.75. A further alternative is to use a moving window averaging method for screen brightness control and a recursive averaging method for dynamic range control, or vice-versa. Other averaging techniques may also be used, as will be familiar to those skilled in the art.

The ambient light sensor 11 may include a plurality of sensors to avoid incorrect readings due to the position of a single sensor. The first and second method may form different spatial averages over the plurality of sensors: the first method forming a first weighted average over the ambient light sensors and the second method forming a second, different weighted average over the ambient light sensors.

The first averaging method for brightness control may use a spatial averaging equally over the ambient light sensors to produce a measure of diffuse ambient light. The first average value AL1 can be calculated as:

$$AL1 = K^{-1}\sum_{i} L_i$$

where the sum is over the ambient light values L of K sensors 1. The method may be refined by excluding from the sum ambient light values of sensors that are occluded, e.g. by excluding sensors for which $L_j<L_{th}$, where $L_{th}$ is a predetermined threshold value, which may have a zero or near-zero value associated with an occluded sensor.

The second average value for controlling the dynamic range compression may be weighted heavily towards those sensors mounted on the display device itself to produce a measure of the specular component of reflection of ambient light on the screen of the display device. This enables the displayed content to respond to changes in ambient light that fall directly on the display itself.

The spatial averaging may include averaging over a first set of sensors in the first method and over a second set of sensors in the second method. The two sets may be overlapping or disjoint. A set may include one or more sensors.

The use of two separate and independent average values for the ambient light provides for a better visual experience of displayed content to the user and ability to produce stable visual quality under a wide range of ambient light conditions. A display control system may use either the temporal averaging or the spatial averaging or both of them. When using a plurality of ambient light sensors, different spatial averaging may be combined with equal temporal averaging and with different temporal averaging.

Figure 3:
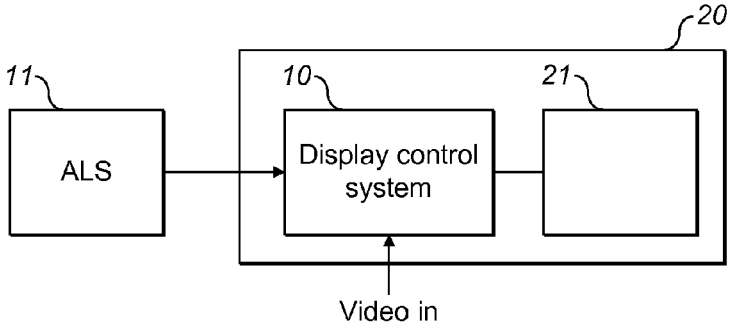
FIG. 3 shows a display apparatus in accordance with embodiments.

FIG. 3 shows schematically a display apparatus 20 in accordance with embodiments including a display control system 10 in accordance with embodiments, and a display device 21. The display device, e.g. an LCD, OLED or other display device, forms an image of the content for viewing by a user.

It will be understood that the processors or processing systems referred to herein may in practice be provided by a single chip or integrated circuit or plural chips or integrated circuits, which may be provided as a chipset, an application-specific integrated circuit (ASIC), field-programmable gate array (FPGA), etc. The chip or chips may comprise circuitry (as well as possibly firmware) for embodying at least one or more of a data processor or processors, a digital signal processor or processors, which are configurable so as to operate in accordance with embodiments. In this regard, embodiments may be implemented at least in part by computer software stored in memory and executable by the processor, or by hardware, or by a combination of software and/or firmware stored on a non-transitory computer-readable storage medium and hardware.

Although at least some aspects of the embodiments described herein with reference to the drawings comprise computer processes performed in processing systems or processors, embodiments also extend to computer programs, particularly computer programs on or in a carrier, adapted for putting the embodiments into practice. The program may be in the form of source code, object code, a code intermediate source and object code such as in partially compiled form, or in any other form suitable for use in the implementation of the processes according to the embodiments described herein. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium; an optical memory device; etc.

The above embodiments are to be understood as illustrative examples. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

What is claimed is:

1. A method of controlling in a display device screen brightness and strength of dynamic range compression of display data in dependence on ambient light level values, the method comprising:

acquiring ambient light level values from one or more ambient light sensors;

averaging the ambient light level values using a first method to obtain a first average value, wherein the first method uses a first temporal averaging;

averaging the ambient light level values using a second method to obtain a second average value, wherein the second method uses a second temporal averaging that is different from the first temporal averaging, such that the first average value is different from the second average value, and wherein at least one of the first and second methods uses moving window averaging;

using the first average value for controlling the screen brightness;

using the second average value for controlling the strength of dynamic range compression; and resetting at least one moving window averaging associated with the at least one of the first and second methods that uses the at least one moving window averaging, when at least one of one or more latest acquired ambient light level values deviates from a corresponding current first or second average value by more than a predetermined threshold value.

2. The method of claim 1, wherein the first temporal averaging is over a longer period than the second temporal averaging.

3. The method of claim 1, wherein the first moving window averaging is reset.

4. The method of claim 1, wherein the second moving window averaging is reset.

5. The method of claim 4, wherein the dynamic range compression is locally adaptive.

6. The method of claim 1, wherein the first and the second moving window averaging are reset.

7. The method of claim 6, wherein the dynamic range compression is locally adaptive.

8. The method of claim 1, wherein the second temporal averaging uses recursive averaging.

9. The method of claim 1, wherein the dynamic range compression is locally adaptive.

10. A display control system for controlling screen brightness and strength of dynamic range compression of display data in a display device based on ambient light level values, the display control system comprising: a processing component configured to:

acquire ambient light level values from one or more ambient light sensors;

average the ambient light level values using a first method to obtain a first average value, wherein the first method uses a first temporal averaging;

average the ambient light level values using a second method to obtain a second average value, wherein the second method uses a second temporal averaging that is different from the first temporal averaging, such that the first average value is different from the second average value, and wherein at least one of the first and second methods uses moving window averaging;

use the first average value for controlling the screen brightness;

use the second average value for controlling the strength of the dynamic range compression; and reset at least one moving window average associated with the at least one of the first and second methods that uses the at least one moving window averaging, when at least one of one or more latest acquired ambient light level values deviates from a corresponding current first or second average value by more than a predetermined threshold value.

11. A non-transitory computer-readable storage medium comprising computer-executable instructions, which, when executed by a processor, cause a computing device to perform a method of controlling in a display device screen brightness and strength of dynamic range compression of display data in dependence on ambient light level values, the method comprising:

acquiring ambient light level values from one or more ambient light sensors;

averaging the ambient light level values using a first method to obtain a first average value, wherein the first method uses a first temporal averaging;

averaging the ambient light level values using a second method to obtain a second average value, wherein the second method uses a second temporal averaging that is different from the first temporal averaging, such that the first average value is different from the second average value, and wherein at least one of the first and second methods uses moving window averaging;

using the first average value for controlling the screen brightness;

using the second average value for controlling the strength of the dynamic range compression, and;

resetting at least one moving window averaging associated with the at least one of the first and second methods that uses the at least one moving window averaging, when at least one of one or more latest acquired ambient light level values deviates from a corresponding current first or second average value by more than a predetermined threshold value.

12. A system for controlling screen brightness and strength of dynamic range compression of display data based on ambient light level values, the system comprising:

a display device; and a processing component configured to:

acquire ambient light level values from one or more ambient light sensors;

average the ambient light level values using a first method to obtain a first average value, wherein the first method uses a first temporal averaging;

average the ambient light level values using a second method to obtain a second average value, wherein the second method uses a second temporal averaging that is different from the first temporal averaging, such that the first average value is different from the second average value, and wherein at least one of the first and second methods uses moving window averaging;

use the first average value for controlling the screen brightness on the display device;

use the second average value for controlling the strength of dynamic range compression on the display device; and reset at least one moving window averaging associated with the at least one of the first and second methods that uses the at least one moving window averaging, when at least one of one or more latest acquired ambient light level values deviates from a corresponding current first or second average value by more than a predetermined threshold value.

* * * * *